US008821139B2

(12) United States Patent
Hicks

(10) Patent No.: US 8,821,139 B2
(45) Date of Patent: Sep. 2, 2014

(54) BALANCE PLATE ASSEMBLY FOR A FLUID DEVICE

(75) Inventor: Aaron Michael Hicks, Eden Prairie, MN (US)

(73) Assignee: Eaton Corporation, Cleveland, OH (US)

( * ) Notice: Subject to any disclaimer, the term of this patent is extended or adjusted under 35 U.S.C. 154(b) by 390 days.

(21) Appl. No.: 13/196,316

(22) Filed: Aug. 2, 2011

(65) Prior Publication Data

US 2012/0034121 A1 Feb. 9, 2012

Related U.S. Application Data

(60) Provisional application No. 61/370,310, filed on Aug. 3, 2010.

(51) Int. Cl.

| | |
|---|---|
| ***F03C 2/00*** | (2006.01) |
| ***F03C 4/00*** | (2006.01) |
| ***F04C 2/00*** | (2006.01) |

(52) U.S. Cl.
USPC ..... 418/61.3; 418/132; 418/179

(58) Field of Classification Search
USPC ..... 418/61.3, 131–132, 166, 171, 178, 179
See application file for complete search history.

(56) References Cited

U.S. PATENT DOCUMENTS

| | | | | |
|---|---|---|---|---|
| 3,490,383 | A | 1/1970 | Parrett | |
| 3,606,600 | A | 9/1971 | Pollman | |
| 3,687,578 | A * | 8/1972 | White et al. | 418/61.3 |
| 4,540,347 | A * | 9/1985 | Child | 418/171 |
| 4,717,320 | A | 1/1988 | White, Jr. | |
| 4,741,681 | A | 5/1988 | Bernstrom | |
| 4,756,676 | A | 7/1988 | Bernstrom | |
| 4,976,594 | A | 12/1990 | Bernstrom | |
| 5,017,101 | A | 5/1991 | White | |
| 5,466,137 | A | 11/1995 | Bierlein et al. | |
| 5,516,268 | A | 5/1996 | Kassen et al. | |
| 5,624,248 | A | 4/1997 | Kassen et al. | |
| 6,074,188 | A * | 6/2000 | White | 418/61.3 |
| 6,086,345 | A | 7/2000 | Acharya et al. | |
| 6,155,808 | A | 12/2000 | White | |
| 7,322,808 | B2 | 1/2008 | Daigre | |

(Continued)

FOREIGN PATENT DOCUMENTS

| | | |
|---|---|---|
| EP | 0 276 680 A2 | 8/1988 |
| EP | 1 026 400 A2 | 8/2000 |

OTHER PUBLICATIONS

International Search Report and Written Opinion for PCT/US2011/046360 mailed Jul. 4, 2013.

*Primary Examiner* — Theresa Trieu
(74) *Attorney, Agent, or Firm* — Merchant & Gould P.C.

(57) ABSTRACT

A fluid device includes a displacement assembly and a balance plate assembly disposed adjacent to the displacement assembly. The displacement assembly includes a ring and a rotor disposed in a bore of the ring. The ring and rotor cooperatively define a plurality of volume chambers. The balance plate assembly includes a housing that defines a cavity. A balance plate is disposed in the cavity. The balance plate includes a first end surface and an oppositely disposed second end surface. The balance plate is adapted to move axially between a first position in which the second end surface of balance plate abuts a first end face of the ring to a second position in which the second surface of the balance plate is recessed in the cavity.

20 Claims, 10 Drawing Sheets

(56) References Cited

U.S. PATENT DOCUMENTS

| | | | | |
|---|---|---|---|---|
| 7,530,801 | B2 | 5/2009 | Hicks | |
| 7,695,259 | B2 | 4/2010 | Miller | |
| 2005/0063851 | A1* | 3/2005 | Phillips | 418/61.3 |
| 2006/0067848 | A1 | 3/2006 | Andersen et al. | |
| 2007/0140886 | A1* | 6/2007 | Baxter et al. | 418/61.3 |

* cited by examiner

BALANCE PLATE ASSEMBLY FOR A FLUID DEVICE

CROSS REFERENCE TO RELATED APPLICATION

This application claims the benefit of U.S. Provisional Application No. 61/370,310, filed Aug. 3, 2010, entitled "Balance Plate Assembly for a Fluid Device," the disclosure of which is incorporated herein by reference in its entirety.

BACKGROUND

Displacement assemblies of conventional fluid pumps/motors require close fits and tight tolerances in order to achieve high volumetric efficiencies. Conventional balance plates are typically used to reduce leakage over the face of the rotating component of the displacement assembly. These conventional balance plates typically contact the rotating component. While these conventional balance plates are effective for many applications, a need exists for a fluid pump/motor with high efficiency that can operate when there is a significant temperature differential between the fluid pump/motor and the fluid communicated to the fluid pump/motor.

SUMMARY

An aspect of the present disclosure relates to a fluid device having a displacement assembly and a balance plate assembly disposed adjacent to the displacement assembly. The displacement assembly includes a ring having a first end face and an oppositely disposed second end face. The ring defines a bore that extends through the first and second end faces. A rotor is disposed in the bore of the ring. The ring and rotor cooperatively define a plurality of volume chambers. The balance plate assembly includes a housing that defines a cavity. A balance plate is disposed in the cavity. The balance plate includes a first end surface and an oppositely disposed second end surface. The balance plate is adapted to move axially between a first position in which the second end surface of balance plate abuts the first end face of the ring to a second position in which the second surface of the balance plate is recessed in the cavity.

Another aspect of the present disclosure relates to a fluid device having a displacement assembly and a balance plate assembly disposed adjacent to the displacement assembly. The displacement assembly includes a ring having a first end face and an oppositely disposed second end face. The ring defines a bore that extends through the first and second end faces. A rotor is disposed in the bore of the ring. The rotor has a first end surface and an oppositely disposed second end surface. The ring and rotor cooperatively define a plurality of volume chambers. The balance plate assembly includes a housing that defines a cavity. A balance plate is disposed in the cavity. The balance plate includes a first end surface and an oppositely disposed second end surface. The balance plate is adapted to move axially between a first position in which the second end surface of balance plate abuts the first end face of the ring and a second position in which the second surface of the balance plate is recessed in the cavity. The rotor actuates the balance plate to the second position.

Another aspect of the present disclosure relates to a fluid device having a displacement assembly and a balance plate assembly disposed adjacent to the displacement assembly. The displacement assembly includes a ring having a first end face and an oppositely disposed second end face. The ring defines a bore and a plurality of openings disposed about the bore that extend through the first and second end faces. A plurality of rolls is disposed in the openings. A rotor is disposed in the bore of the ring. The rotor includes a first end surface and an oppositely disposed second end surface. The ring, rolls and rotor cooperatively define a plurality of volume chambers. The balance plate assembly includes a housing that defines a cavity. A spring is disposed in the cavity. A balance plate is disposed in the cavity. The balance plate includes a first end surface abutting the spring and an oppositely disposed second end surface. The balance plate is adapted to move axially between a first position in which the second end surface of balance plate abuts the first end face of the ring to a second position in which the second surface of the balance plate is recessed in the cavity. Thermal expansion of the rotor actuates the balance plate to the second position.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
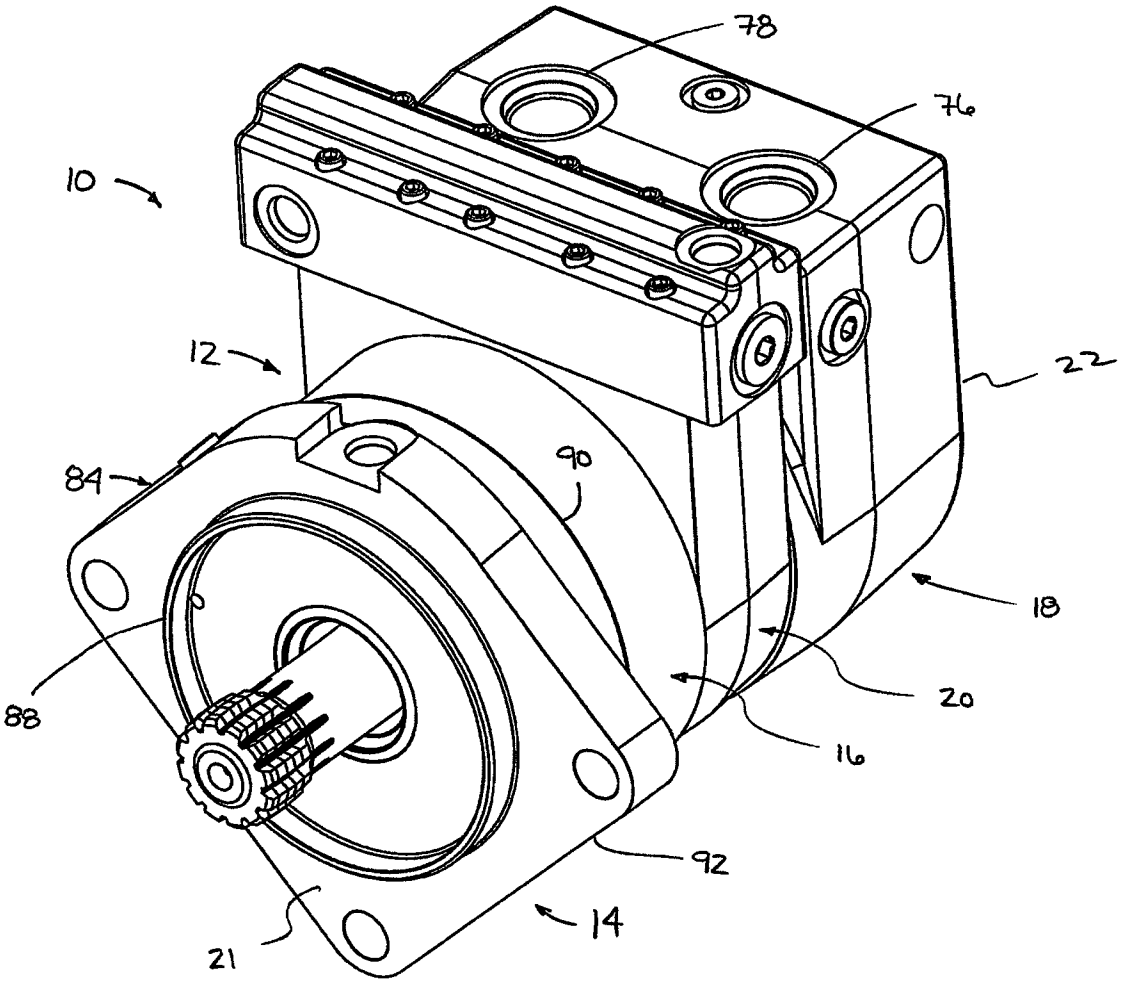
FIG. 1 is a perspective view of a fluid device having exemplary features of aspects in accordance with the principles of the present disclosure.
Figure 2:
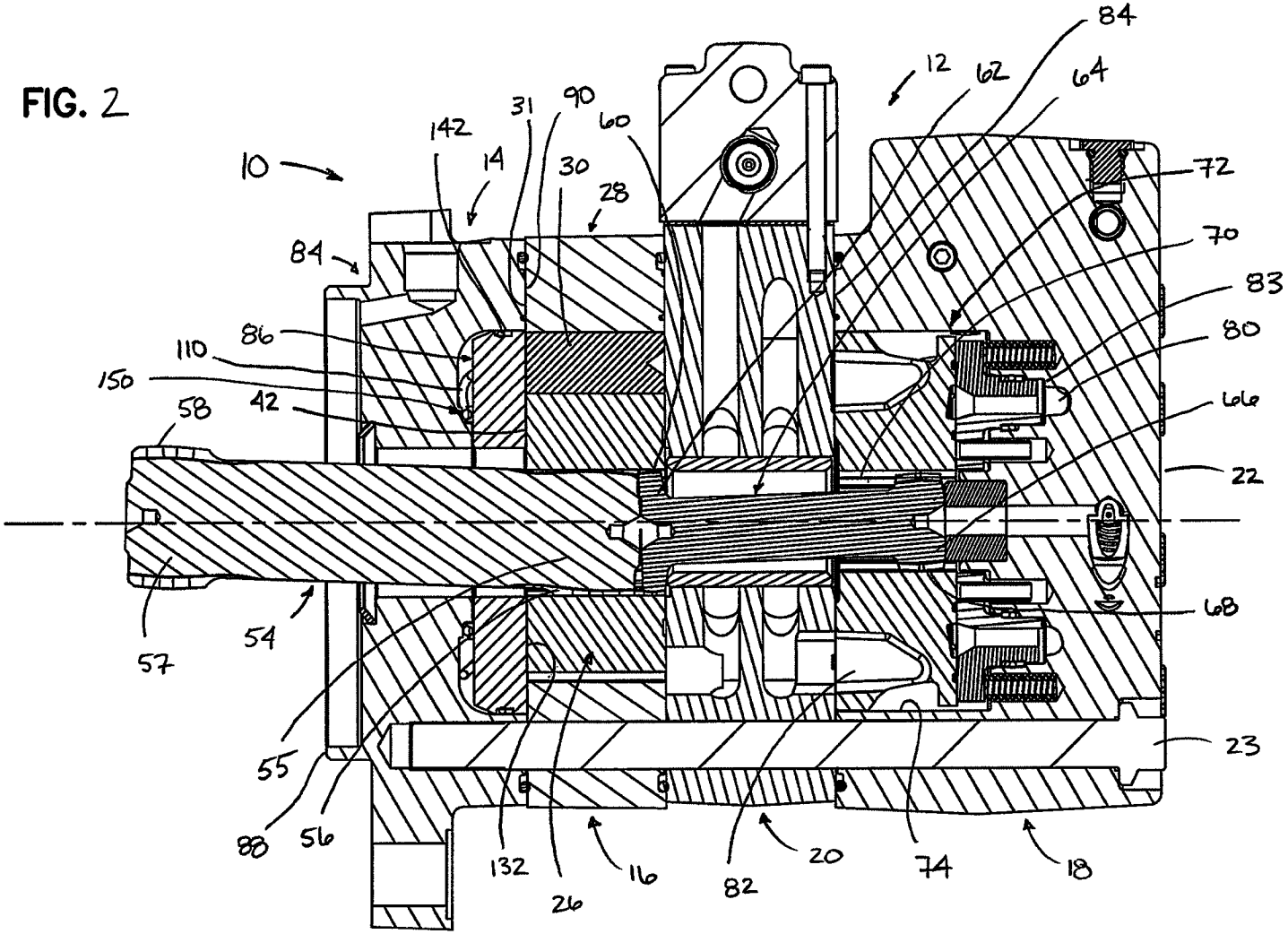
FIG. 2 is a cross-sectional view of the fluid device of FIG. 1.

Referring now to FIGS. 1 and 2, a fluid device 10 is shown. While the fluid device 10 can be used as a fluid pump or a fluid motor, the fluid device 10 will be described herein as a fluid motor.

The fluid device 10 includes a housing assembly 12. The housing assembly 12 includes a balance plate assembly 14, a displacement assembly 16, a valve housing 18 and a valve plate 20. In the depicted embodiment, the housing assembly 12 is a bearingless assembly. It will be understood, however, that the scope of the present disclosure is not limited to the housing assembly 12 being a bearingless assembly as the housing assembly 12 could be adapted to receive an output shaft with bearings.

In the depicted embodiment, the balance plate assembly 14 is disposed at a first axial end 21 of the fluid device 10 while the valve housing 18 is disposed at a second axial end 22, which is opposite the first axial end 21. The displacement assembly 16 is disposed between the balance plate assembly 14 and the valve housing 18 and the valve plate 20 is disposed between the displacement assembly 16 and the valve housing 18. The balance plate assembly 14, the displacement assembly 16, the valve housing 18 and the valve plate 20 are held in engagement by a plurality of fasteners 23 (e.g. bolts, screws, etc.). In the depicted embodiment, the fasteners 23 are in threaded engagement with the balance plate assembly 14.

Referring now to FIGS. 2-5, the displacement assembly 16 is shown. The displacement assembly 16 includes a ring assembly 24 and a rotor 26.

The ring assembly 24 includes a ring 28 and a plurality of rolls 30. It will be understood, however, that the scope of the present disclosure is not limited to including rolls 30. In the depicted embodiment, the ring 28 is rotationally stationary relative to the fluid device 10. The ring 28 is manufactured from a first material. In one embodiment, the first material is ductile iron. In another embodiment, the first material is grey iron. In another embodiment, the first material is steel. The ring 28 includes a first end face 31 that is generally perpendicular to a central axis 32 of the ring 28 and an oppositely disposed second end face 33.

The ring 28 defines a central bore 34 and a plurality of openings 35 disposed about the central bore 34. In the depicted embodiment, the openings 35 are generally semi-cylindrical in shape. The rolls 30 are disposed in the openings 35 so that each of the rolls 30 can rotate about a central longitudinal axis 36 of the roll 30. In the depicted embodiment, the ring assembly 24 includes nine rolls 30. In another embodiment, the ring assembly 24 includes seven rolls 30.

Eccentrically disposed in the central bore 34 of the ring assembly 24 is the rotor 26. The rotor 26 is adapted to orbit about the central axis 32 of the ring 28 and rotate in the central bore 34 of the ring assembly 24 about an axis 40 of the rotor 26.

The rotor 26 is manufactured from a second material. In one embodiment, the second material is different from the first material. In one embodiment, the second material is steel. The rotor 26 includes a first end surface 42 and an oppositely disposed second end surface 44.

The rotor 26 includes a plurality of external teeth 46 and a plurality of internal splines 48 that extend between the first and second end surfaces 42, 44. In the depicted embodiment, the number of external teeth 46 on the rotor 26 is one less than the number of rolls 30 in the ring assembly 24. The ring assembly 24 and the external teeth 46 of the rotor 26 cooperatively define a plurality of volume chambers 50. As the rotor 26 orbits and rotates in the ring assembly 24, the volume chambers 50 expand and contract.

The second end surface 44 of the rotor 26 defines an annular groove 52. The annular groove 52 is disposed between the external teeth 46 and the internal splines 48 of the rotor 26.

Referring now to FIG. 2, the fluid device 10 includes a main drive shaft 54. The main drive shaft 54 includes a first end 55 having a first set of external crowned splines 56 and an opposite second end 57 having a second set of external crowned splines 58. The internal splines 48 of the rotor 26 are in engagement with the first set of external, crowned splines 56. The second set of external crowned splines 58 is adapted for engagement with internal splines of a customer-supplied output device (e.g., a shaft, coupler, etc.).

In the depicted embodiment, the internal splines 48 of the rotor 26 are also in engagement with a first set of external splines 60 formed on a first end 62 of a valve drive 64. The valve drive 64 includes an oppositely disposed second end 66 having a second set of external splines 68. The second set of external splines 68 are in engagement with a set of internal splines 70 formed about an inner periphery of a valve member 72 that is rotatably disposed in a valve bore 74 of the valve housing 18. The valve drive 64 is in splined engagement with the rotor 26 and the valve member 72 to maintain proper timing between the rotor 26 and the valve member 72.

While the fluid device 10 is depicted as having a valve member that is of a disc-valve type, it will be understood, however, that the scope of the present disclosure is not limited to the valve member 72 being of the disc-valve type. In alternative embodiments, the valve member 72 could be of the spool-valve type or a valve-in-star type.

Referring now to FIGS. 1 and 2, the valve housing 18 defines a first fluid port 76 and a second fluid port 78. The first fluid port 76 is in fluid communication with the valve bore 74 of the valve housing 18. The second fluid port 78 is in fluid communication with an annular cavity 80 that is disposed adjacent to the valve bore 74.

The valve member 72 defines a first plurality of fluid passages 82 that is in fluid communication with the valve bore 74 and a second plurality of fluid passages (not shown) that is in fluid communication with the annular cavity 80. The first and second pluralities of fluid passages are alternately disposed in the valve member 72.

A valve-seating mechanism 83 biases the valve member 72 toward a valve surface 84 of the valve plate 20. A valve-seating mechanism suitable for use with the fluid device 10 has been described in U.S. Pat. No. 7,530,801, which is hereby incorporated by reference in its entirety. It will be understood, however, that conventional valve-seating mechanisms may be used in the alternative.

As the valve member 72 rotates, the valve member 72 slides in a rotary motion against the valve surface 84 of the valve plate 20. The valve member 72 and the valve plate 20 provide commutating fluid communication to the volume chambers 50 of the displacement assembly 16. A valve plate suitable for use with the fluid device 10 has been described in U.S. Pat. No. 7,695,259, which is hereby incorporated by reference in its entirety. It will be understood, however, that conventional valve plates may be used in the alternative.

Referring now to FIGS. 1, 2 and 6-8, the balance plate assembly 14 will be described. In the depicted embodiment, the balance plate assembly 14 includes a housing 84 and a balance plate 86 disposed in the housing 84.

The housing 84 includes a first axial end 88 and an oppositely disposed second axial end 90. In the depicted embodiment, the housing 84 includes a flange 92 disposed between the first and second axial ends 88, 90. The flange 92 extends outwardly from the housing 84. The flange 92 is adapted to abut a support structure (e.g., mounting bracket, vehicle frame, axle etc.) so that the fluid device 10 can be secured to the support structure. The flange 92 defines a plurality of mounting holes 94 that extend through the flange 92. The mounting holes 94 are adapted to receive fasteners to fasten the fluid device 10 to the support structure. While the housing 84 is shown as having the flange 92, it will be understood that the scope of the present disclosure is not limited to the housing 84 having the flange 92 as a separate mounting structure such as a mounting plate and/or bearing assembly (e.g., output shaft with bearings disposed in a bearing housing) could be engaged to the housing 84.

The housing 84 defines a bore 96 that extends through the first and second axial ends 88, 90. The bore 96 is configured so that the main drive shaft 56 passes through the bore 96. The bore 96 defines a central axis 97 that extends through the bore 96.

In the depicted embodiment, the first axial end 88 includes a pilot portion 98 that extends outwardly from the housing 84 in a direction that is generally perpendicular to the flange 92. In the subject embodiment, the pilot portion 98 is generally cylindrical in shape and is adapted to align the fluid device 10 with the corresponding support structure to which the fluid device 10 is mounted.

The second axial end 90 defines a plurality of holes 100 that is adapted for engagement with the fasteners 23. In the depicted embodiment, the holes 100 include internal threads that are adapted to receive external threads of the fasteners 23.

The second axial end 90 further defines a cavity 102. The cavity 102 is adapted to receive the balance plate 86. The cavity 102 is defined by a base wall 104 and a side wall 106. The base wall 104 defines a spring cavity portion 108. The spring cavity portion 108 is a recessed portion in the cavity 102 that is adapted to receive a spring 110. In the depicted embodiment, the spring 110 is a wave spring. Alternatively, the spring 110 may be a Belleville-type spring or a coil-type spring.

The base wall 104 further defines a plurality of alignment holes 112. The alignment holes 112 are disposed in the spring cavity portion 108. In the depicted embodiment, there are two oppositely disposed alignment holes 112.

The side wall 106 is generally perpendicular to the base wall 104. The side wall 106 has an inner diameter that is less than the innermost diameter of the holes 100.

The housing 84 defines a fluid passage 114 that is in fluid communication with the spring cavity portion 108 of the cavity 102. The fluid passage 114 receives pressurized fluid from one of the first and second fluid ports 76, 78 through a shuttle valve.

In one embodiment, the shuttle valve is disposed in the valve housing 18. In another embodiment, the shuttle valve is disposed in the valve plate 20.

In one embodiment, the pressurized fluid from the shuttle valve is passed through the valve plate 20 and the ring 28 to a first portion 116 of the fluid passage 114. The first portion 116 of the fluid passage 114 is disposed a radial distance from the central axis 97 of the housing 84 that is greater than the radius of the side wall 106 and less than a radius of a circle that circumscribes the holes 100.

The first portion 116 of the fluid passage 114 is in fluid communication with a second portion 118 of the fluid passage 114. The second portion 118 of the fluid passage 114 is disposed at a radial distance from the central axis 97 of the housing 84 that is greater than a radius of the 96 and less than a radius of the side wall 106. In the depicted embodiment, the second portion 118 is in fluid communication with the spring cavity portion 108 of the cavity 102.

In the depicted embodiment, the first and second portions 116, 118 of the fluid passage 114 are connected by a connection passage 120. The connection passage 120 extends from the flange 92 and intersects the first and second portions 116, 118 of the fluid passage 114. In the depicted embodiment, the connection passage 120 is plugged at the flange 92. The plug allows fluid to be communicated from the first portion 116 to the second portion 118 but prevents fluid from leaking out the fluid device 10. In one embodiment, a threaded plug is inserted into the connection passage 120 at the flange 92.

The base wall 104 of the cavity 102 defines a groove 122 disposed between the bore 96 and the spring cavity portion 108. The groove 122 includes a sealing surface 124 that is generally cylindrical in shape. The sealing surface 124 extends in a direction that is generally parallel to the central axis 97.

Referring now to FIGS. 2 and 9-11, the balance plate 86 is shown. In the depicted embodiment, the balance plate 86 is manufactured from a steel material (e.g., 8620, etc.) that is subsequently heat treated. In another embodiment, the balance plate 86 is manufactured from a ductile iron material (e.g., 65-45-12, 80-55-06, etc.).

The balance plate 86 is generally cylindrical in shape. The balance plate 86 includes a first end surface 130, an oppositely disposed second end surface 132 and an outer surface 134 that extends between the first and second end surfaces 130, 132. The balance plate 86 defines a central opening 136 through which the main drive shaft 56 passes.

The balance plate 86 includes a plurality of alignment pins 138. The alignment pins 138 are adapted for engagement with the alignment holes 112 in the cavity 102 of the housing 84. The alignment pins 138 extend outwardly from the first end surface 130 of the balance plate 86 in a direction that is generally perpendicular to the first end surface 130. In the depicted embodiment, the alignment pins 138 are roll pins that are in press fit engagement with holes defined by the balance plate 86.

The outer surface 134 of the balance plate 86 has an outer diameter that is less than an inner diameter of the side wall 106 of the cavity 102 of the housing 84. The outer surface 134 defines a seal groove 140. The seal groove 140 is adapted to receive a seal 142 (shown in FIG. 2). In one embodiment, the seal 142 is an o-ring. In another embodiment, the seal 142 is a lip seal. In another embodiment, the seal 142 is a quad-ring seal.

The outer surface 134 of the balance plate 86 includes a reduced diameter portion 144 disposed between the first end surface 130 and the seal groove 140. An outer diameter of the reduced diameter portion 144 decreases as the reduced diameter portion 144 approaches the first end surface 130. In the depicted embodiment, the reduced diameter portion 144 is a taper. In another embodiment, the reduced diameter portion 144 is a radius.

Referring now to FIG. 2, the assembly of the balance plate assembly 14 will be described. The spring 110 is positioned in the spring cavity portion 108 of the cavity 102 of the housing 84. A seal assembly 150 is disposed in the groove 122. In the depicted embodiment, the seal assembly 150 includes a sealing member (e.g., an o-ring) and a sealing washer.

With the seal 142 installed in the seal groove 140 of the balance plate 86, the alignment pins 138 of the balance plate 86 are aligned with the alignment holes 112 in the housing 84. The balance plate 86 is inserted into the cavity 102 until the first end surface 130 abuts the spring 110.

Referring now to FIGS. 1-11, the operation of the fluid device 10 will be described. The rotor 26 of the displacement assembly 16 has a width that is measured from the first end surface 42 to the second end surface 44. The width of the rotor 26 is less than a width of the ring 28, which is measured from the first end face 31 to the second end face 33. The difference between the width of the rotor 26 and the width of the ring 28 is referred to as side clearance.

The amount of side clearance in a convention fluid pump/motor affects the operation of the conventional fluid pump/motor. As side clearance in the conventional fluid pump/ motor increases, volumetric efficiency of the fluid pump/motor decreases. The greater the side clearance, the greater the amount of fluid that can leak over the faces of the rotating member of the displacement assembly. As the amount of fluid that leaks over the faces of the rotating member increases, the volumetric efficiency of the fluid pump/motor decreases since the leaking fluid does not contribute to the operation of the fluid pump/motor.

While reduced side clearances result in higher volumetric efficiencies in conventional fluid pumps/motors, reduced side clearances can result in mechanical seizure of the conventional fluid pumps/motors during cold start-up condition (i.e., a thermo-shock condition). In a cold start-up condition, the temperature of the fluid pump/motor is low (e.g., ambient temperature). The fluid routed to the fluid pump/motor, on the other hand, is at a higher temperature (e.g., about 70° F. higher than the fluid pump/motor). With fluid passing through the displacement assembly of the fluid pump/motor, the width of the rotating member becomes temporarily larger than the width of the ring, which causes the rotating member to seize between surfaces immediately adjacent to the displacement assembly. This increase in width is due to the difference between the rate of thermal expansion of the rotating member and the rate of thermal expansion of the corresponding ring.

The balance plate assembly 14 of the fluid device 10 addresses the cold-start-up issues of conventional fluid pumps/motors while maintaining high volumetric efficiencies. The balance plate 86 of the balance plate assembly 14 is adapted to move axial between a first position 200 and a second position 204. In the first position, the second end surface 132 of the balance plate 86 is biased into contact with the first end face 31 of the ring 28. In the depicted embodiment, the balance plate 86 is biased into contact with the ring 28 by fluid pressure communicated to the cavity 102 of the balance plate assembly 14 and/or the spring 110, which is disposed in the cavity 102. As the balance plate 86 is in contact with the ring 28 and the housing 84 is in contact with the ring 28, the second end surface 132 of the balance plate 86 is generally coplanar with the second axial end 90 of the housing 84.

Figure 2A:
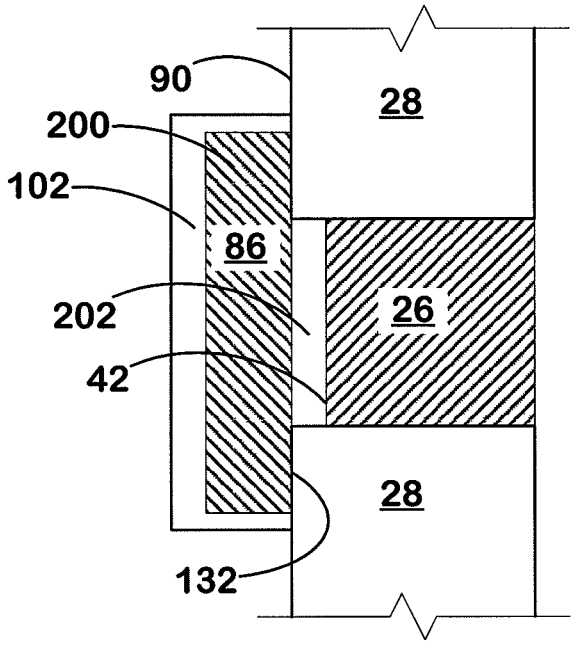
FIG. 2A is a schematic cross-sectional view of a balance plate of the fluid device of FIG. 1 in a first position.

In the first position 200, schematically shown in FIG. 2A, the balance plate 86 contacts the ring 28 at an outer portion of the second end surface 132 of the balance plate 86. In the depicted embodiment, a width of the balance plate 86 is such that deflection of the balance plate 86 is minimize or eliminated so that an inner portion of the second end surface 132 of the balance plate 86 does not deflect into contact with the first end surface 42 of the rotor 26. In one embodiment, there is a gap 202 between the first end surface 42 of the rotor 26 and the second end surface 132 of the balance plate 86 when the balance plate 86 in contact with the ring 28 and when a differential temperature between the fluid and the fluid device 10 is less than 70° F.

As the fluid device 10 operates, pressurized fluid, which is routed through the fluid passage 114 to the cavity 102, acts against the first end surface 131 of the balance plate 86 to keep the balance plate 86 in contact with the ring 28. By keeping the balance plate 86 in contact with the ring 28 during operation, the displacement assembly 16 has a generally constant side clearance.

Figure 2B:
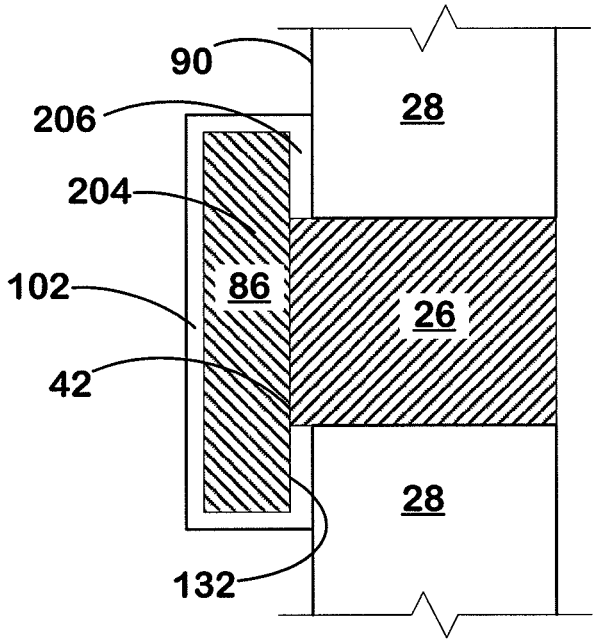
FIG. 2B is a schematic cross-sectional view of a balance plate of the fluid device of FIG. 1 in a second position.
Figure 3:
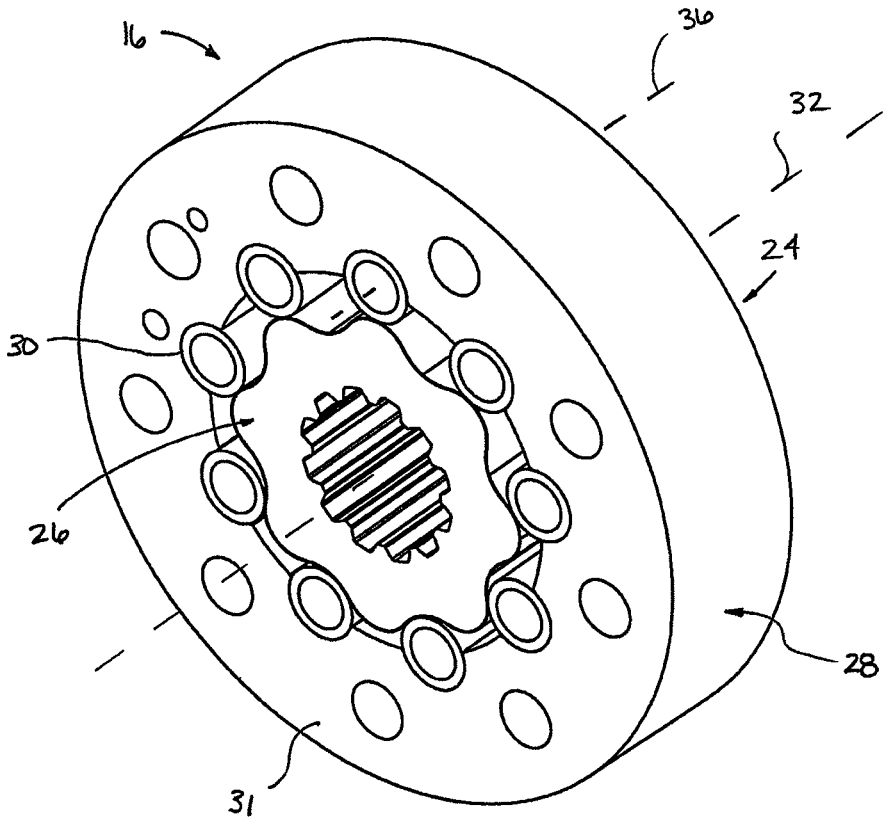
FIG. 3 is a perspective view of a displacement assembly suitable for use with the fluid device of FIG. 1.
Figure 4:
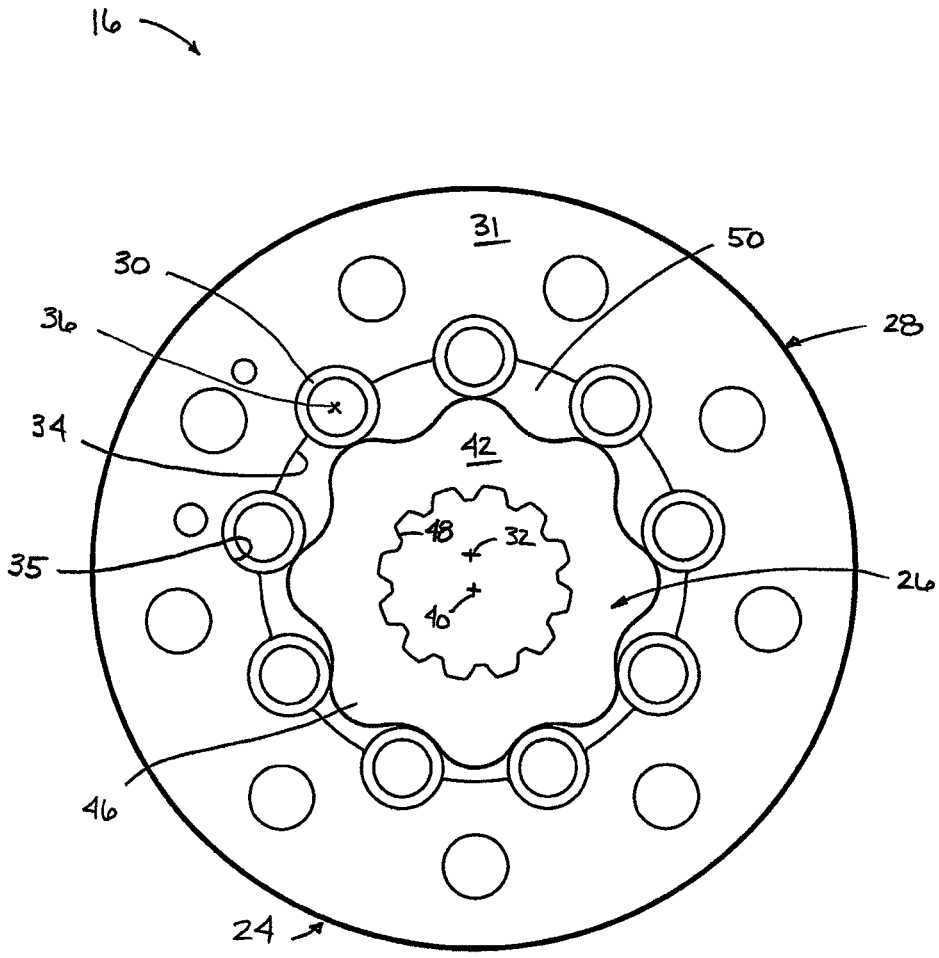
FIG. 4 is a front view of the displacement assembly.
Figure 5:
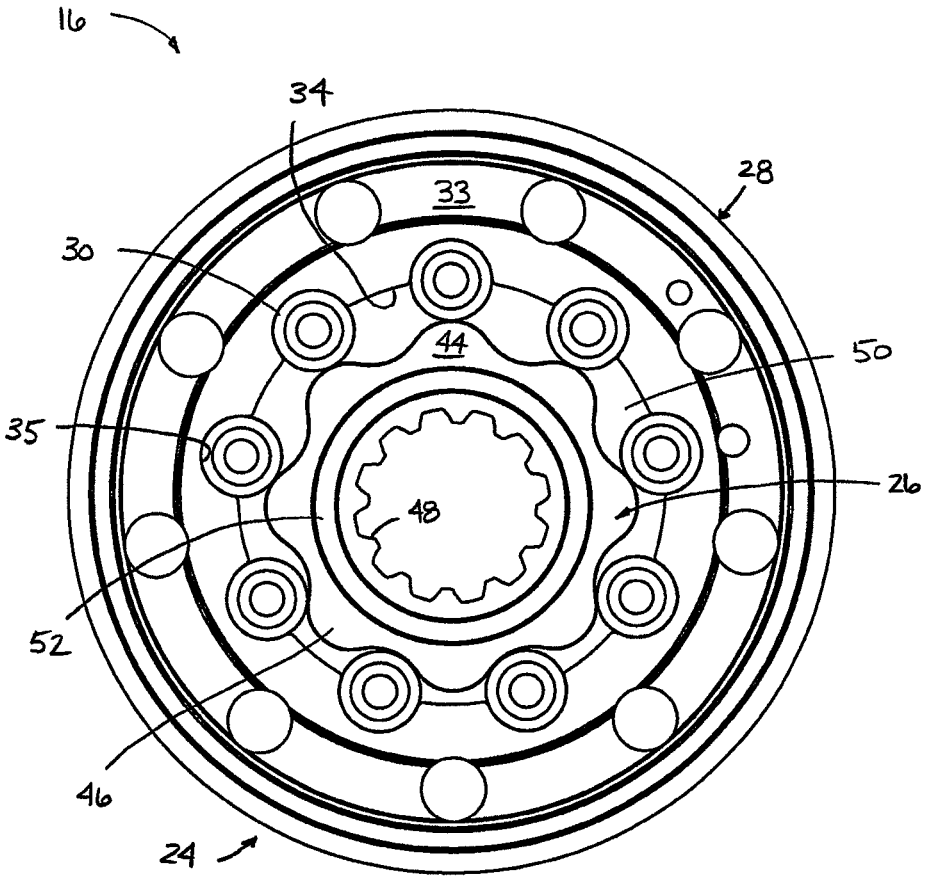
FIG. 5 is a rear view of the displacement assembly.
Figure 6:
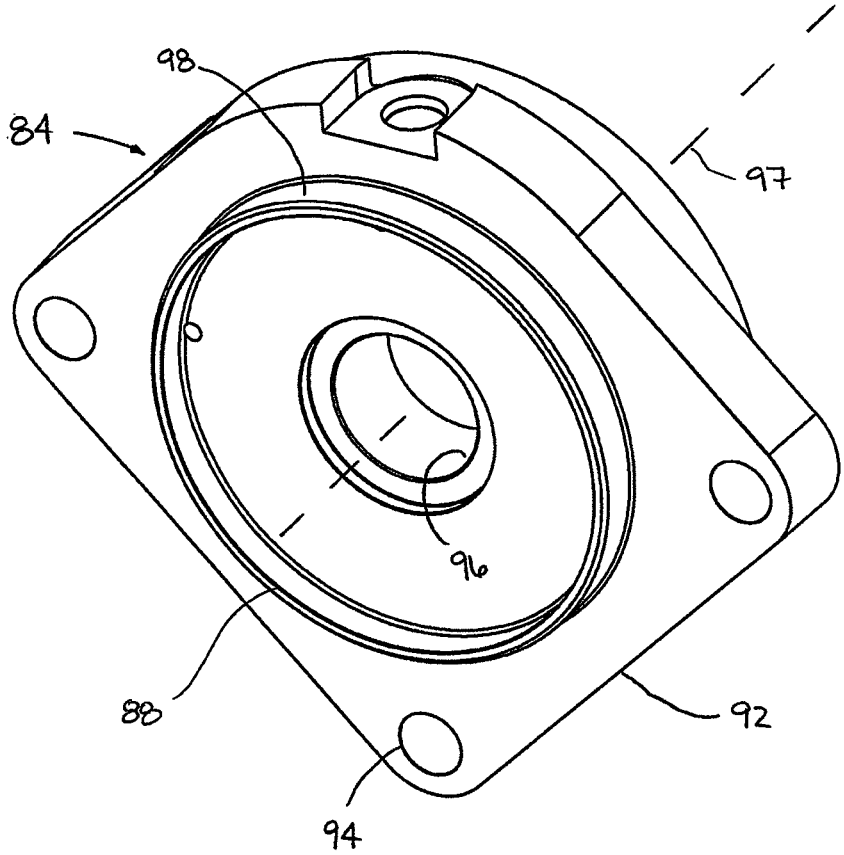
FIG. 6 is a perspective view of a first axial end of a housing of a bearing plate assembly suitable for use with the fluid device of FIG. 1.
Figure 7:
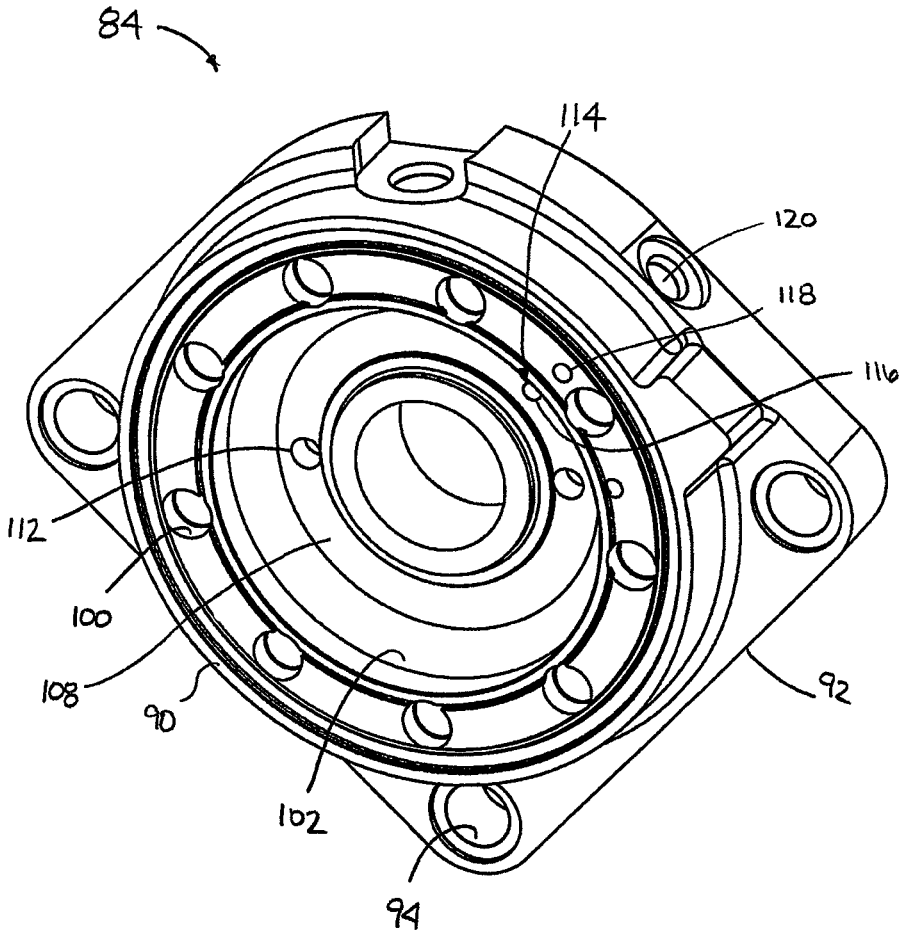
FIG. 7 is a perspective view of a second axial end of the housing of FIG. 6
Figure 8:
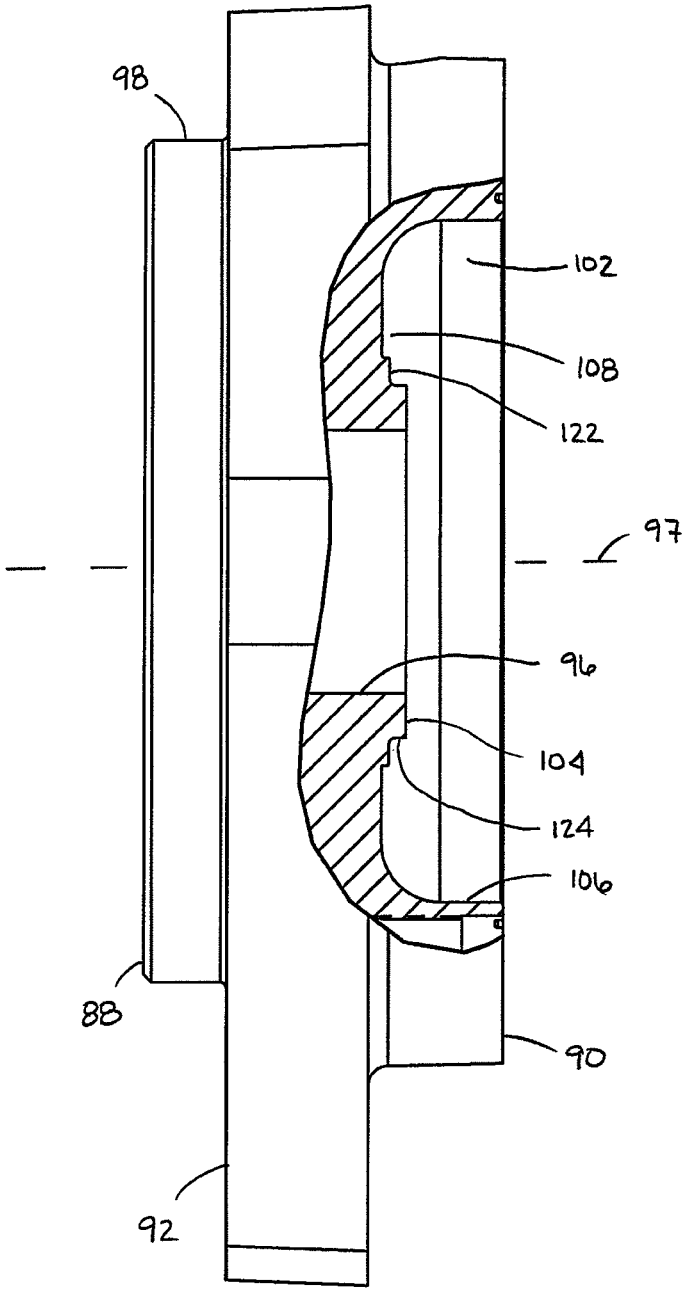
FIG. 8 is a side view of the housing of FIG. 6 showing a fragmentary cross-section.
Figure 9:
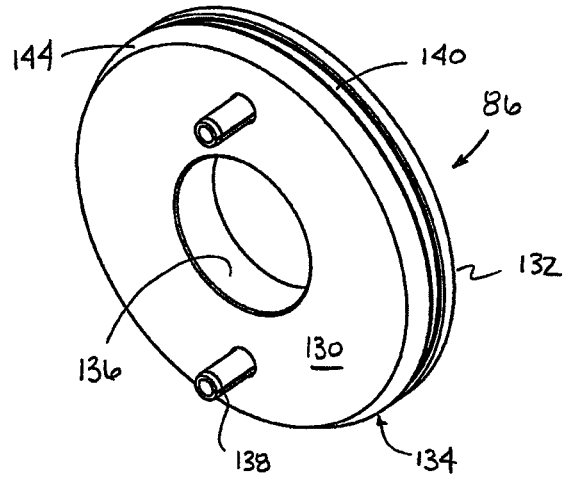
FIG. 9 is a perspective view of a balance plate suitable for use with the fluid device of FIG. 1.
Figure 10:
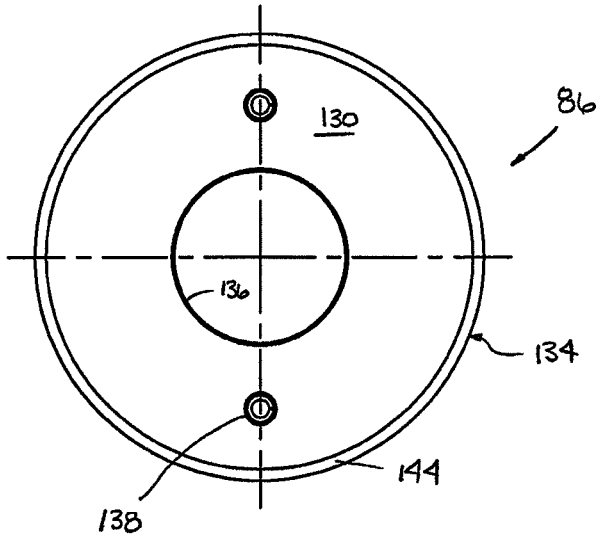
FIG. 10 is a front view of the balance plate of FIG. 9.
Figure 11:
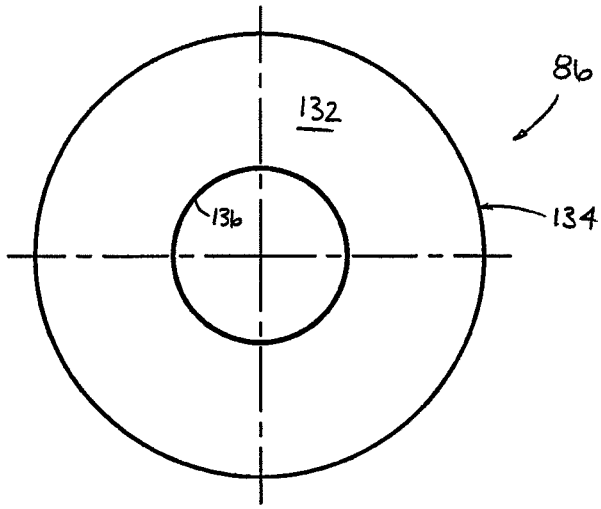
FIG. 11 is a rear view of the balance plate of FIG. 9.

In the second position 204, the balance plate 86 is axially moved into the cavity 102 so that the second end surface 132 of the balance plate 86 is recessed from the second axial end 90 of the housing 84 to form a gap 206, as schematically show in FIG. 2B. When the starting differential temperature between the fluid and the fluid device 10 is in a cold start-up temperature range (i.e., temperature of the fluid minus the temperature of the fluid device 10 is greater than about 70° F.), the rotor 26 thermally expands at a rate that is greater than a rate of thermal expansion of the ring 28. As a result, the width of the rotor 26 becomes greater than the width of the ring 28. As the width of the rotor 26 expands, the side clearance between the first end surface 42 of the rotor 26 and the second end surface 132 of the balance plate 86 decreases. When the width of the rotor 26 exceeds the width of the ring 28, the first end surface 42 of the rotor 26 contacts the second end surface 132 of the balance plate 86 and pushes the balance plate 86 in an axial direction into the cavity 102 of the housing 84. The depth of the cavity 102 is greater than the distance between the first and second end surfaces 130, 132 of the balance plate 86. Therefore, when the width of the rotor 26 is greater than the width of the ring 28, the rotor 26 pushes against the balance plate 86 so that the second end surface 132 of the balance plate 86 is recessed relative to the second axial end 90 of the housing 84. With the second end surface 132 of the balance plate 86 recessed in the cavity 102, the first end surface 42 of the rotor 26 can enter the cavity 102. This allows for the rotor 26 of the displacement assembly 16 to orbit and rotate relative to the ring 28 even though the width of the rotor 26 is greater than the width of the ring 28.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A fluid device comprising:

a displacement assembly including:

a ring having a first end face and an oppositely disposed second end face, the ring defining a bore that extends through the first and second end faces;

a rotor having a first end surface and being disposed in the bore of the ring, wherein the ring and the rotor cooperatively define a plurality of volume chambers;

a balance plate assembly disposed adjacent to the displacement assembly, the balance plate assembly including:

a housing defining a cavity;

a balance plate disposed in the cavity, the balance plate having a first end surface and an oppositely disposed second end surface, the balance plate being adapted to move axially between a first position in which the second end surface of the balance plate abuts the first end face of the ring and is spaced from the rotor first end surface to a second position in which the second end surface of the balance plate abuts the rotor first end surface and is spaced away from the ring such that the balance plate is recessed in the cavity.

2. The fluid device of claim 1, further comprising a rotatable valve member in fluid communication with the volume chambers of the displacement assembly.

3. The fluid device of claim 2, wherein the rotatable valve member is a disc-valve-type valve member.

4. The fluid device of claim 1, wherein the displacement assembly includes a plurality of rolls rotatably disposed in a plurality of openings disposed about the bore in the ring.

5. The fluid device of claim 1, wherein the housing includes a flange that extends outwardly from the housing.

6. The fluid device of claim 1, wherein the balance plate is biased toward the ring by a spring.

7. The fluid device of claim 6, wherein the spring is a wave-type spring.

8. The fluid device of claim 6, wherein the spring is disposed in a recessed spring cavity portion of the cavity.

9. The fluid device of claim 1, wherein the housing of the balance plate assembly defines a fluid passage that is adapted to route fluid to the cavity.

10. A fluid device comprising:

a displacement assembly including:

a ring having a first end face and an oppositely disposed second end face, the ring defining a bore that extends through the first and second end faces, the ring having a first rate of thermal expansion and being constructed to thermally expand in a first axial direction;

a rotor disposed in the bore of the ring, the rotor having a first end surface and a second end surface, wherein the ring and the rotor cooperatively define a plurality of volume chambers, the rotor being constructed to thermally expand in the first axial direction, the rotor having a second rate of thermal expansion greater that the first rate of thermal expansion such that the rotor expands at a greater rate that the ring;

a balance plate assembly abutting the displacement assembly, the balance plate assembly including:

a housing defining a cavity; and a balance plate disposed in the cavity, the balance plate having a first end surface and an oppositely disposed second end surface, the balance plate being adapted to move axially between a first position in which the second end surface of the balance plate abuts the first end face of the ring and a second position in which the second end surface of the balance plate is in contact with the rotor first end surface and is recessed in the cavity, wherein the first end surface of the rotor actuates the balance plate to the second position.

11. The fluid device of claim 10, wherein displacement assembly includes a plurality of rolls disposed in a plurality of openings defined about the bore of the ring.

12. The fluid device of claim 10, wherein there is a gap disposed between the first end surface of the rotor and the second end surface of the balance plate when the balance plate is in the first position.

13. The fluid device of claim 10, wherein the balance plate includes a plurality of alignment pins that extend outwardly from the first end surface of the balance plate.

14. The fluid device of claim 13, wherein the cavity includes a plurality of alignment holes that is adapted to receive the plurality of alignment pins of the balance plate.

15. The fluid device of claim 10, wherein an outer surface of the balance plate that extends between the first and second end surfaces defines a seal groove that receives a seal that is adapted to seal against a sidewall of the cavity.

16. A method for compensating for thermal expansion of a displacement assembly of a fluid motor, the method comprising:

providing a fluid device having:

a displacement assembly including:

a ring having a first end face and an oppositely disposed second end face, the ring defining a bore that extends through the first and second end faces;

a rotor disposed in the bore of the ring, wherein the ring and rotor cooperatively define a plurality of volume chambers;

a housing including a first axial end and an oppositely disposed second axial end, the second axial end defining a cavity; and a balance plate having a first end surface and an oppositely disposed second end surface, the balance plate being disposed in a first position in which the second end surface of the balance plate abuts the first end face of the ring;

thermally expanding the rotor to contact and actuate the balance plate in a first axial direction to a second position such that the balance plate is spaced away from the ring and the balance plate is disposed in the cavity.

17. The method for compensating for thermal expansion of a displacement assembly of a fluid motor of claim 16, wherein:

the step of providing a fluid device includes providing a ring having a first rate of thermal expansion and includes providing a rotor having a second rate of thermal expansion that is different from the first rate of thermal expansion.

18. The method for compensating for thermal expansion of a displacement assembly of a fluid motor of claim 17, wherein:

the step of actuating the balance plate includes actuating the balance plate to the second position when a temperature difference between the fluid device and a fluid within the fluid device is greater than a first temperature value.

19. The method for compensating for thermal expansion of a displacement assembly of a fluid motor of claim 18, wherein:

the step of actuating the balance plate includes actuating the balance plate to the second position when a temperature difference between the fluid device and a fluid within the fluid device is greater than about 70 degrees Fahrenheit.

20. The method for compensating for thermal expansion of a displacement assembly of a fluid motor of claim 19, wherein:

the ring has a first width and the rotor has a second width greater than the first width when the temperature difference is greater than the first temperature value.

* * * * *